United States Patent [19]

Attenasio

[11] Patent Number: 4,822,022

[45] Date of Patent: Apr. 18, 1989

[54] APPARATUS FOR LIFTING A FLEXIBLE SHEET

[75] Inventor: Ann T. Attenasio, Revere, Mass.

[73] Assignee: The Charles Stark Draper Laboratory, Inc., Cambridge, Mass.

[21] Appl. No.: 171,264

[22] Filed: Mar. 21, 1988

[51] Int. Cl.[4] ..... B65H 3/08

[52] U.S. Cl. ..... 271/97; 271/90

[58] Field of Search ..... 271/90, 97, 108, 20, 271/98; 221/211, 278; 294/64.3; 414/737; 901/40

[56] References Cited

U.S. PATENT DOCUMENTS

| | | | |
|---|---|---|---|
| 3,993,301 | 11/1976 | Vits | 294/64.3 |
| 4,632,046 | 12/1986 | Barrett et al. | 112/121.14 |
| 4,638,749 | 1/1987 | Wood | 112/121.12 |
| 4,641,827 | 2/1987 | Walton et al. | 271/18.3 |
| 4,645,193 | 2/1987 | Walton et al. | 271/18.3 |
| 4,735,449 | 4/1988 | Kuma | 294/64.3 |

FOREIGN PATENT DOCUMENTS 1191456 5/1970 United Kingdom .

OTHER PUBLICATIONS

Technical Digest, No. 20, Oct. 1970, "Pickup and Orienting Tool", by D. Demuzio, H. Huber.

Ito (Attenasio) "Design of a Vacuum Picker for Automated Handling of Textiles", Bachelor of Science Thesis, MIT, submitted Jun. 1, 1987.

*Primary Examiner*—Kevin P. Shaver
*Assistant Examiner*—Mona C. Beegle
*Attorney, Agent, or Firm*—Lahive & Cockfield

[57] ABSTRACT

A device for lifting a limp sheet member is disclosed. This device comprises a first tubular sleeve member which encloses an elongated interior region extending along a reference axis. The sleeve member has substantially planar, circular, aperture-defining rim disposed about and coaxial with the reference axis at the distal end of the interior region. The proximal end of the interior region is coupled to a region of relatively low pressure. The device also comprises structure for defining a composite airflow path from a region of relatively high pressure, through the first rim and interior region to the low pressure region, and includes vanes, grooves or sleeves for establishing an airflow vortex in the composite airflow path substantially at the first rim and disposed about the reference axis.

24 Claims, 5 Drawing Sheets

APPARATUS FOR LIFTING A FLEXIBLE SHEET

REFERENCE TO RELATED PATENT

This application is related to the subject matter of U.S. Pat. No. 4,632,046 assigned to the assignee of the present invention.

BACKGROUND OF THE INVENTION

This invention relates to systems for the automated or computer-controlled manipulation of flexible sheet or limp material segments. More particularly, this invention relates to a device for automatically lifting flexible sheet or limp material segments from a support. The invention is particularly well adapted for use in automated textile garment assembly systems where it is important to reliably lift a single sheet.

The complex textile manipulations required in the assembly of garments are typically performed manually, causing them to be very labor-intensive. As a result, labor costs are high, causing the resulting clothing products to be expensive. The automation of garment assembly would be of great economic value by providing a more efficient and less expensive mode of manufacture.

Various mechanical devices have been used in the prior art for automated cloth manipulation, but problems have accompanied their usefulness. For example, articulated robotics, although being quite capable of moving rigid objects, have not been as successful in handling more flexible objects such as cloth. Some automated textile handling devices use teeth, pinchers, needles, or other moving parts. These devices often damage the fabric during manipulation, for example, by snagging, tearing, stretching, or creasing of the fabric. These devices may also damage the textile supporting work surface. For example, if the teeth or needles of the device should impale the cloth or miss it completely, the wear on the work surface is accelerated.

In addition, the separation of a single ply of limp fabric from the top of a stack of such plies has not been satisfactorily accomplished with the prior art devices. Removal of a single ply from a stack of cut plies of a woven fabric is a particularly difficult task to execute, even for human hands, because the edge threads of such plies are often slightly interlocked as a result of being cut together.

Approaches have been taken in the prior art to utilize hollow needles which are automated so as to penetrate and lift the top ply of fabric from a stack in part with the assistance of air flow through the needles. In these approaches, the penetration of the needles presents potential for damaging the fabric and work surface.

Other approaches have utilized vacuum flow as a lifting means for example as disclosed in U.S. Pat. No. 4,632,046. However, when such devices are used to lift the top ply of fabric from a stack, typically more than one ply is lifted, particularly when the fabric is permeable to airflow.

Accordingly, it is an object of the present invention to provide an improved system of automated cloth manipulation to be used in article assembly.

Another object is to provide an automated system of cloth manipulation which does not damage the cloth.

Yet another object is to provide an automated system of flexible or limp sheet ply separation.

A further object is to provide a non-damaging system of ply separation and manipulation which is inexpensive and efficient.

SUMMARY OF THE INVENTION

Briefly, the present invention is directed to a limp material handling system including a device for selectively manipulating or lifting a single ply of limp material from the top of a stack of plies, or directly from a support.

The device generally provides controlled air flow to establish a vortex at a lifting portion of the device. The vortex provides a pressure distribution which generates a pressure differential across the top ply of a stack of plies.

In one form of the invention, the lifting device includes a first tubular sleeve member enclosing an elongated interior region extending along a reference axis. This tubular member has a first substantially planar, circular, aperture-defining rim disposed about and coaxial with the reference axis at the distal end of its interior region. The first sleeve member also includes means for coupling the proximal end of its interior region to a region of relatively low pressure, such as may be established by a vacuum pump. In some forms of the invention, the first sleeve member may have a substantially circular cross-section and may be substantially cylindrical in shape.

In addition to the first sleeve member, the lifting device is further adapted to define a composite airflow path from a relatively high pressure region, such as may be established by an air pump, through the aperture-defining rim and interior region of the sleeve member, to the low pressure region. This means for defining an airflow path also establishes an airflow vortex within the airflow path, the vortex being substantially at the aperture-defining rim of the first sleeve member, and disposed about the reference axis.

The lifting device may further include a guide for establishing a portion of the composite airflow path having a substantially annular cross-section, and located at least near the aperture-defining rim of the first sleeve member. This annular portion of the composite airflow path extends in the direction of the reference axis and about the first sleeve member.

In one embodiment of the invention, the guide consists of a second tubular sleeve member disposed about the first sleeve member, and extending along a central axis coaxial with the reference axis. This second sleeve member has a second substantially planar, circular, aperture-defining rim disposed at its distal end near the first rim of the first sleeve member. The principle planes of the rims may be substantially coaxial and parallel.

In a preferred form of tfhe invention, both the first and second sleeve members have a substantially circular cross-section, and are substantially cylindrical. In addition, the distal end of the second sleeve member may extend beyond the distal end of the first sleeve member. In this form of the invention, the rim of the first sleeve member is within the region interior to the second sleeve member and is displaced from the rim of the second sleeve member in the direction of the reference axis.

In another embodiment of the invention, the means for defining the composite airflow path may include a plurality of tube members disposed about the first sleeve member. Each of the tube members defines an airflow path from a relatively high pressure region, through an exit port, and extending along a central axis directed, at least in part, circumferentially with respect to the reference axis. The circumferential component of the airflow from the tube members assists in establishing the vortex.

In forms of the invention having the first and second concentric tube members, the vortex at the rim of the first sleeve member may be established by a plurality of helically arranged grooves extending into surfaces of the first and second sleeve members. In various embodiments, the grooves may extend into the inner surface of the second sleeve member (i.e., facing the region between the first and second sleeve members), or may extend into the inner surface of the first sleeve member (i.e., facing the interior region of that sleeve member), or may extend into the outer surface of the first sleeve member (i.e., facing the region between the first and second sleeve members, or any combination thereof.

Alternatively, the vortex at the rim of the first sleeve member may be established by a plurality of helically arranged vanes or ribs projecting from the inner surface of the second sleeve member into the region between the sleeve members, or projecting from the inner surface of the first sleeve member into its interior region, or projecting from the outer surface of the first sleeve member into the region between the sleeve members, or any combination thereof.

With all of these configurations, the device may be positioned with respect to the top ply of a stack so that the vortex is proximal to that top ply. The pressure distribution of the vortex causes a pressure differential across the top ply, which acts together with circumferentially directed shear forces, to separate and lift the top ply from the stack. This lifting device is particularly useful for lifting a ply of air-permeable fabric, but it also suitable for lifting non-porous sheets, such as paper, or the like.

BRIEF DESCRIPTION OF THE DRAWINGS

The foregoing and other objects of this invention, the various feaures thereof, as well as the invention itself, may be more fully understood from the following description, when read together with the accompanying drawing in which.

DESCRIPTION OF THE PREFERRED EMBODIMENT

Figure 1:
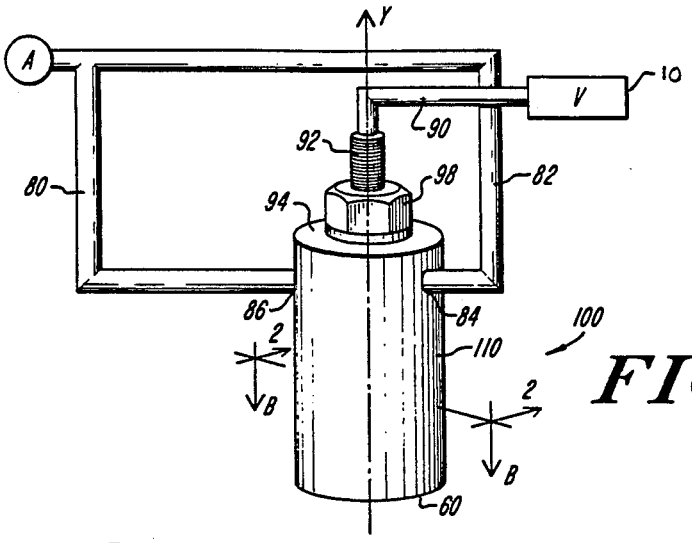
FIG. 1 shows an isometric view of an exemplary embodiment of the present invention.
Figure 2:
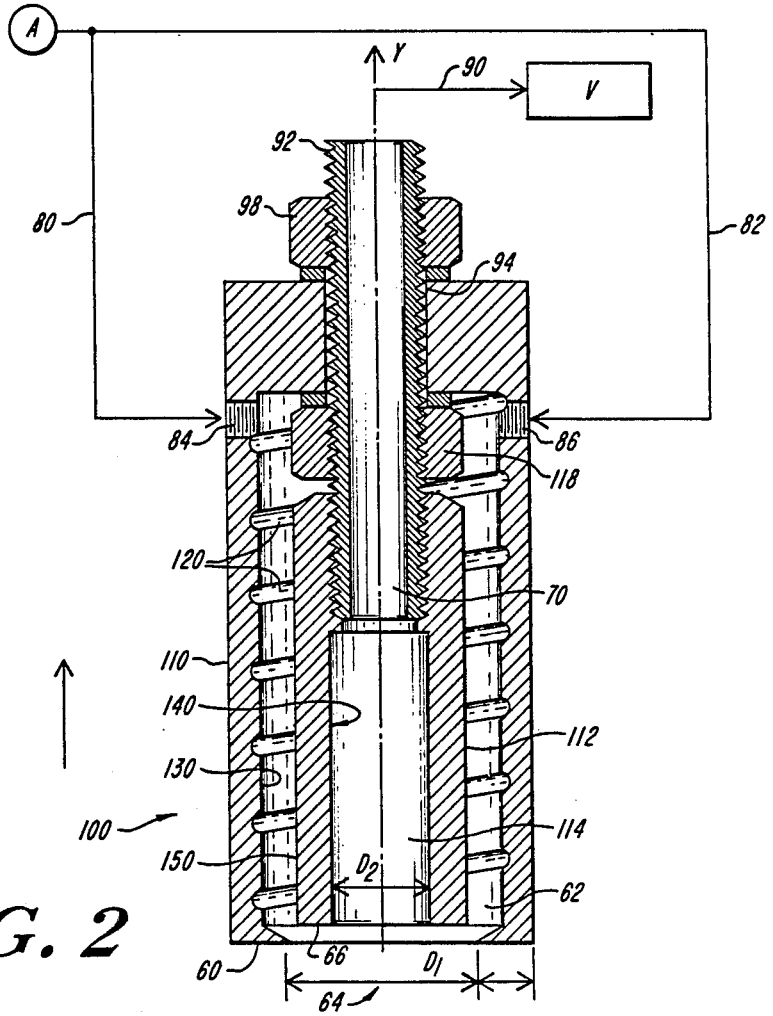
FIG. 2 shows a sectional view taken along line 2—2 of the device shown in FIG. 1.
Figure 3A:
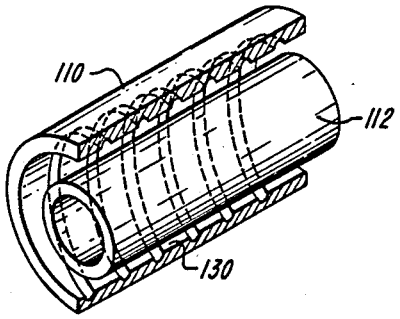
FIGS. 3A–3G show cut-away views of alternative embodiments of the device shown in FIG. 1.
Figure 3B:
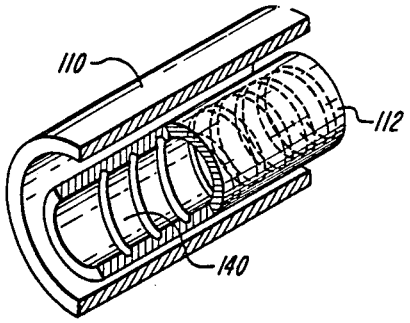
Figure 3C:
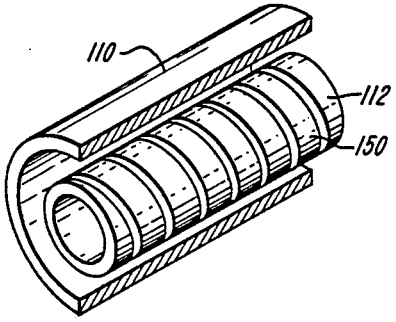
Figure 3D:
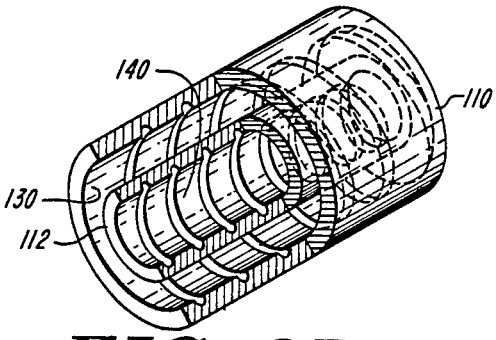
Figure 3E:
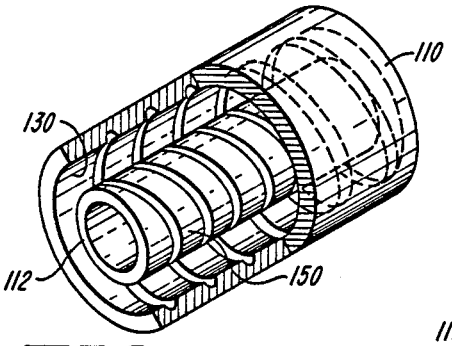
Figure 3F:
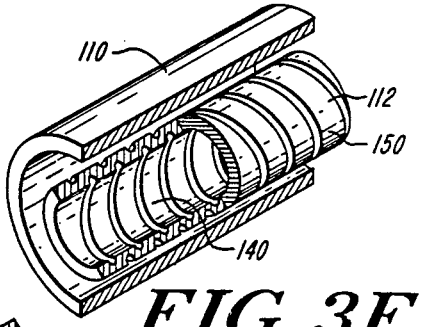
Figure 3G:
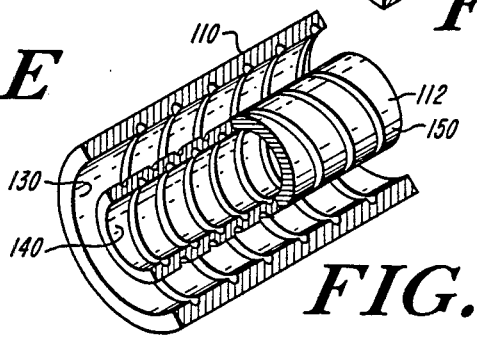
Figure 4A:
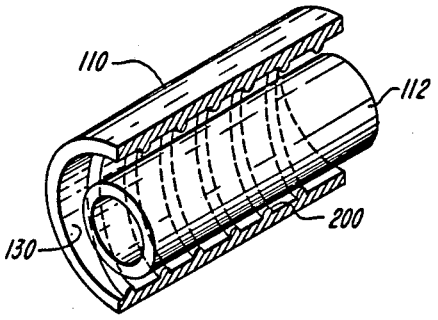
FIGS. 4A–4G show cut-away views of alternative embodiments of the device shown in FIG. 1.
Figure 4B:
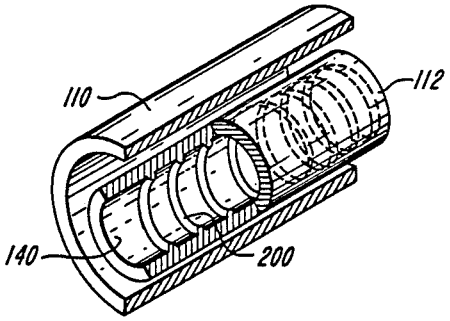
Figure 4C:
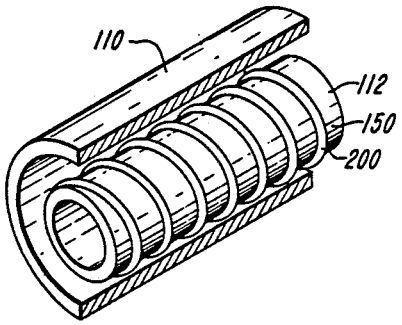
Figure 4D:
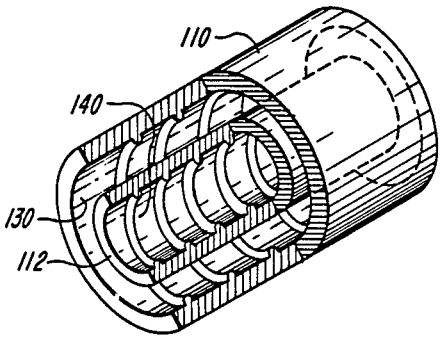
Figure 4E:
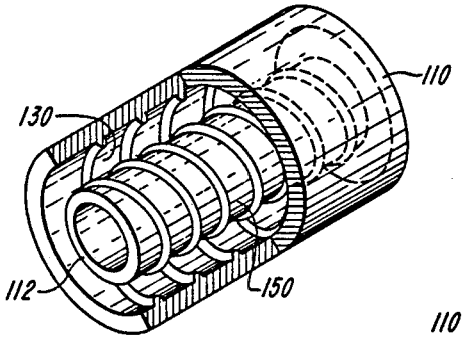
Figure 4F:
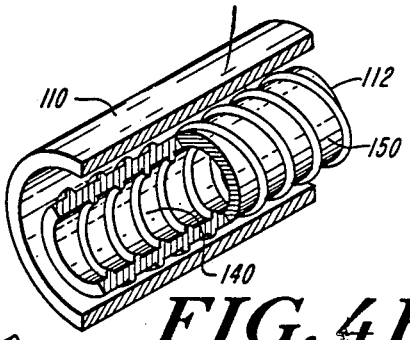
Figure 4G:
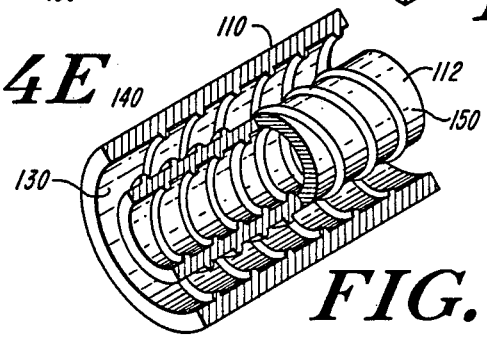

FIG. 1 shows an isometric representation of principal elements of a preferred form of a lifting device 100 and plumbed pneumatics, and FIG. 2 shows the device 100 in section along line 2—2. The device 100 includes outer tubular sleeve member 110 which extends along reference axis Y and encloses an interior region 62. Sleeve member 110 is capped at its proximal end 94 and inclues a rim 60 at its distal end which defines a planar, circular aperture 64 having diameter D1. Pneumatic lines 80 and 82 are coupled between outer tubular sleeve member 110 at airflow ports 84 and 86 and a relatively high pressure reservoir A. An externally threaded hollow rod 92 extends through the capped end 94 of outer tubular sleeve member 110. Hollow rod 92 is affixed to that capped end by nuts 96 and 118. A pneumatic line 90 is coupled between the end of hollow rod 92 and a relatively low pressure reservoir V.

An inner tubular sleeve member 112 is disposed within region 62. Inner sleeve member 112 is affixed to an end of hollow rod 92, and encloses an interior region 114 which is continuous with the interior region 70 of hollow rod 92, vacuum line 90, and vacuum source 10. The distal end of inner sleeve member 112 includes a planar, circular, aperture-defining rim 66.

In the illustrated embodiment, the rim 66 is coaxial with, and recessed (in the direction of the Y axis) from rim 60 of outer sleeve member 110. A plurality of helically arranged grooves 120 is located in inner surface 130 of sleeve member 110 (i.e., facing region 62).

During operation of the device 100, air is supplied from air reservoir (or pump) A by way of lines 80 and 82 and ports 84 and 86 to the annular region 62 between sleeve members 110 and 112, and a vacuum is applied by way of line 90 and hollow rod 92 to the region 114. The helically arranged grooves 120 cause the resultant air in region 62 to flow in a helical path out to aperture 64. The air from aperture 64 is drawn into region 114 and back to the vacuum reservoir V. An airflow vortex is established at rim 60 of outer sleeve member 110, and disposed about the reference axis Y when the airflow and vacuum are so applied. By appropriately positioning the device 100 so that the vortex is adjacent to a sheet of limp material, the resultant pressure distribution provides a lifting and separating force on the sheet of material, as described more fully below.

In the illustrated embodiment, the vortex is established as a result of the helical air flow at the regions adjacent to aperture 64 and rim 66. This helical air flow is established by grooves 120 in region 62. As in the embodiments described below, this flow may also be obtained by establishing a helical flow in region 62. For example, as shown in the cut-away views of FIGS. 3A–3G, other embodiments may include a plurality of helical grooves corresponding to grooves 120, where the further set of grooves may be positioned on the inner surface 140 of inner sleeve member 112 (i.e., facing interior region 70), on the outer surface 150 of inner sleeve member 112 (i.e., facing the region 62 between the sleeve members), or any combination thereof.

The required helical airflow alternatively may be established by patterns of vanes or ribs in lieu of, or in addition to the grooves illustrated in FIGS. 3A–3G. For example, FIGS. 4A–4G show cut-away views of alternative embodiments of the device shown in FIG. 1. A plurality of helically arranged ribs or vanes 200 may extend from inner surface 130 of outer sleeve member 110 facing region 62, inner surface 140 of inner sleeve member 112, outer surface 150 of inner sleeve member 112, or any combination thereof.

Figure 5:
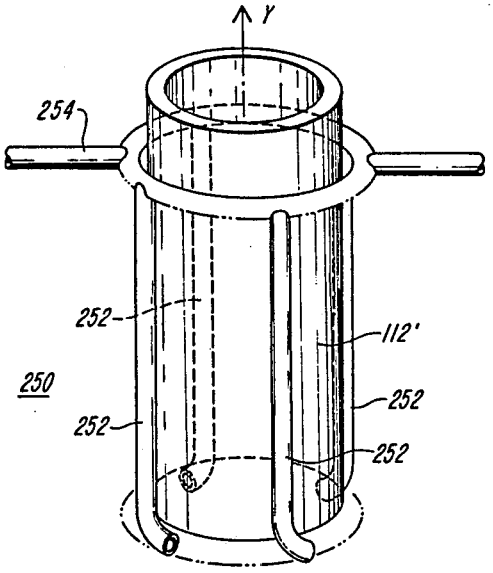
FIG. 5 shows another exemplary embodiment of the present invention.

Another exemplary embodiment 250 of the invention is depicted in FIG. 5. The device 250 includes inner sleeve member 112 positioned around the periphery of member 112 (which is similar to sleeve member 112 of FIG. 1) and a continuum of outer sleeve members 252 (only four are shown in FIG. 5). Each of members 252 define an airflow path, and together define a composite annular path. The ends of these outer tube members 252 extend along central axes directed, at least in part, circumferentially with respect to the reference axis Y. The proximal end of each tube member 252 is coupled to an air line 254, which in turn is coupled to an airflow source. This alternative embodiment also establishes an airflow similar to that described above for the embodiment of FIGS. 1 and 2.

Figure 6A:
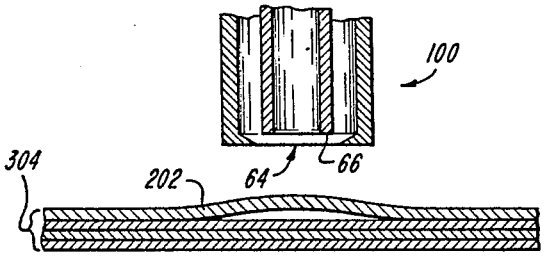
FIGS. 6A–6C illustrates the operation of the embodiment of FIG. 1.
Figure 6B:
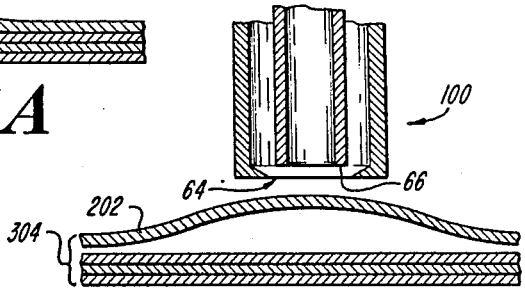
Figure 6C:
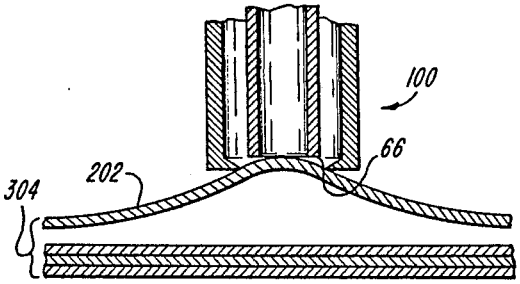

FIGS. 6A–6C illustrate the manner in which a single fabric ply is lifted by the lifting device 100 from a stack of plies. Initially, device 100 is brought into position over the stack 304 and lowered toward the stack. The vortex at the lowermost end of device 100 establishes low pressure above the uppermost ply 202 relative to the pressure in the region below that ply, causing that ply to lift and approach aperture 64 of device 100. The circumferential airflow of the vortex further acts to establish a shear force which laterally shifts the ply 202 with respect to the next lower ply, aiding in the separation of those plies. As shown in the succession of FIGS. 6A–6C, the ply 202 finally comes close enough to device 100 to become engaged to it at its inner sleeve rim 66.

Thus, during operation, a flexible uppermost ply is lifted to conform to a constant pressure surface at atmospheric pressure in response to the vortex established above it. In a simplified model, the vortex air velocity distribution in polar coordinates, $v_r$ and $v_\Theta$ can be expressed as $v_r=0$ and $v_\Theta=K/r$, where the strength of the vortex, $K=V_0r_0$, $V_0$ is a reference velocity, and $r_0$ is a reference radius. According to Bernoulli's equation, $$p+\rho V^2/2+\rho gz=\text{constant}$$

where p is the pressure, V the velocity, $\rho$ the density of the air, r the radius, z the height, and g the acceleration of gravity. Substituting the velocity of the vortex flow for V, and solving for z, the shape of a constant pressure surface of the vortex becomes $$z_{p=p1}=\frac{\text{constant}-p_1}{\rho g}-\frac{K^2}{2gr^2}$$

Figure 7A:
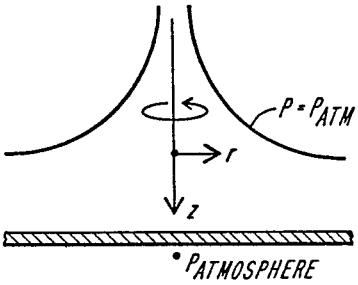
FIGS. 7A and 7B illustrate the interaction of the vortex with an exemplary ply.
Figure 7B:
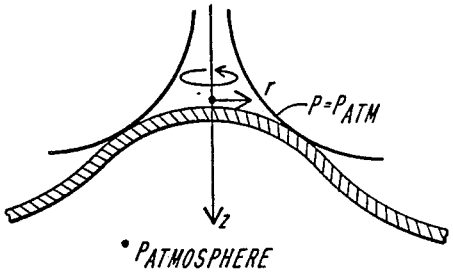

The pressure under the top ply of the stack is essentially atmospheric. As the vortex nears the ply, it changes the shape of the atmospheric pressure surface to the shape described in the above equation and shown in FIGS. 7A and 7B. The top ply conforms to the constant pressure surface which equals atmospheric pressure.

Figure 8:
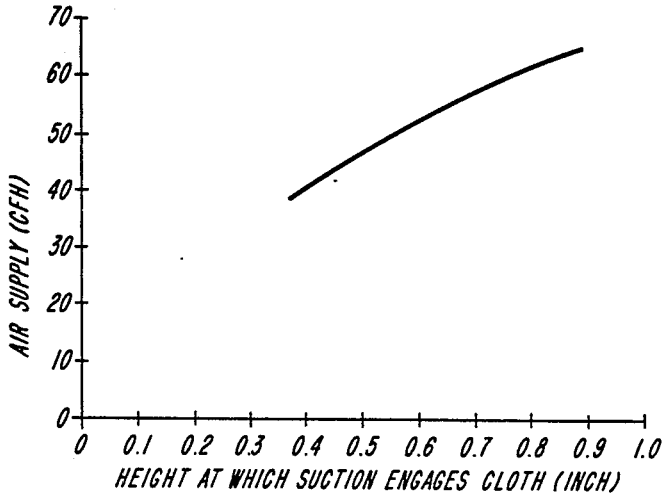
FIG. 8 shows for an exemplary lifting device the relationship between the height at which the device engages a ply and the airflow rate.

The variable parameters of interest are K, the strength of the vortex, z, the height of the device above the stack, and r, the radius. Both K and z can be adjusted to the weight of the plies to be lifted, while r is limited by the practical physical size of the device. In the embodiment illustrated in FIG. 2, where D1=0.875 inches and D2=0.375 inches, if the strength of the vortex is varied by adjusting the velocity of the airflow, the height at which the device engages the cloth varies by a squared relation, as illustrated in FIG. 8. This data was obtained using the lifting device of FIG. 2 mounted to drill press to give unbiased, repeatable vertical displacement and a mid-weight, wool/polyester plain weave fabric.

TABLE I shows that the height at which the device engages the fabric is dependent on the fabric type. Therefore, the weight and permeability of the fabric to be lifted are additional significant parameters to consider when operating the device.

TABLE I

| fabric type | relative permeability | relative weight | height to engage cloth |
|---|---|---|---|
| seersucker | 1 (high) | 1 (low) | 0.70 inch |
| wool/poly plain weave | 2 | 3 | 0.73 |
| wool/poly plain weave, smooth fibers | 3 | 2 | 0.83 |
| wool/poly tweed | 4 | 4 | 0.95 |

The invention may be embodied in other specific forms without departing from the spirit or essential characteristics thereof. The present embodiments are therefore to be considered in all aspects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for lifting a flexible sheet member, said device comprising:

(a) a first tubular sleeve member enclosing an elongated interior region extending along a reference axis and having a first substantially planar, aperture-defining rim disposed about and coaxial with said reference axis at the distal end of said interior region, said sleeve member including means for coupling the proximal end of said interior region to a relatively low pressure region; and (b) means for defining a composite airflow path from a relatively high pressure region, through said first rim and said interior region to said low pressure region, and including means for establishing an airflow vortex in said composite airflow path substantially at said first rim and disposed about said reference axis.

2. The device of claim 1 further comprising guide means for establishing a substantially annular cross-section airflow path at least near said first rim, said annular path extending in the direction of said reference axis and about said first sleeve member.

3. The device of claim 1 wherein said means for defining said composite airflow path comprises a plurality of tube members, each of which defines an air flow path from said relatively high pressure region through an exit port, and extending along a central axis directed, at least in part, circumferentially with respect to said reference axis.

4. The device of claim 1 wherein said first sleeve member has a substantially circular cross-section.

5. The device of claim 1 wherein said first sleeve member is substantially cylindrical.

6. The device of claim 2 wherein said guide means comprises a second tubular sleeve member disposed about said first sleeve member and extending along a central axis coaxial with said reference axis, said second sleeve member having a second substantially planar aperture-defining rim disposed at its distal end near said first rim of said first sleeve member wherein the principal planes of said first and second rims are substantially coaxial and parallel.

7. The device of claim 6 wherein said first and second sleeve members have substantially circular cross-sections.

8. The device of claim 6 wherein said first and second sleeve members are substantially cylindrical.

9. The device of claim 6 wherein said means for establishing said vortex comprises a plurality of helically arranged vanes projecting from said second sleeve member into a region between said sleeve members.

10. The device of claim 6 wherein said means for establishing said vortex comprises a plurality of helically arranged vanes projecting from said first sleeve member into said interior region.

11. The device of claim 6 wherein said means for establishing said vortex comprises a plurality of helically arranged vanes projecting from said first sleeve member into a region between said sleeve members.

12. The device of claim 9 wherein said means for establishing said vortex further comprises a plurality of helically arranged vanes projecting from said first sleeve member into said interior region.

13. The device of claim 9 wherein said means for establishing said vortex further comprises a plurality of helically arranged vanes projecting from said first sleeve member into said region between said sleeve members.

14. The device of claim 10 wherein said means for establishing said vortex further comprises a plurality of helically arranged vanes projecting from said first sleeve member into a region between said sleeve members.

15. The device of claim 12 wherein said means for establishing said vortex further comprises a plurality of helically arranged vanes projecting from said first sleeve member into said region between said sleeve members.

16. The device of claim 6 wherein said means for establishing said vortex comprises a plurality of helically arranged grooves extending into the surface of said second sleeve member facing a region between said sleeve members.

17. The device of claim 6 wherein said means for establishing said vortex comprises a plurality of helically arranged grooves extending into the surface of said first sleeve member facing said interior region.

18. The device of claim 6 wherein said means for establishing said vortex comprises a plurality of helically arranged grooves extending into the surface of said first sleeve member facing a region between said sleeve members.

19. The device of claim 16 wherein said means for establishing said vortex further comprises a plurality of helically arranged grooves extending into the surface of said first sleeve member facing said interior region.

20. The device of claim 16 wherein said means for establishing said vortex comprises a plurality of helically arranged grooves extending into the surface of first sleeve member facing said region between said sleeve members.

21. The device of claim 17 wherein said means for establishing said vortex further comprises a plurality of helically arranged grooves extending into the surface of said first sleeve member facing a region between said sleeve members.

22. The device of claim 19 wherein said means for establishing said vortex further comprises a plurality of helically arranged grooves extending into the surface of said first sleeve member facing said region between said sleeve members.

23. The device of claim 6 wherein said distal end of said second sleeve member extends beyond said distal end of said first sleeve member.

24. The device of claim 6 wherein said first rim is within a region interior to said second sleeve member, said first rim being displaced from said second rim in the direction of said reference axis.

* * * * *